United States Patent [19]

Senyagin et al.

[11] Patent Number: 4,802,328

[45] Date of Patent: Feb. 7, 1989

[54] METHOD OF MANUFACTURING WIRE ROPES AND WIRE ROPE TWISTING MACHINE FOR EFFECTING THE SAME

[75] Inventors: Georgy V. Senyagin; Anatoly V. Kazakov, both of Tashkent, U.S.S.R.

[73] Assignee: Nauchno-Issledovatelsky Proektno-Konstruktorsky I Tekhnologichesky Kabelny Institut Niki Po "Sredazkabel", U.S.S.R.

[21] Appl. No.: 44,034

[22] Filed: Feb. 25, 1987

[51] Int. Cl.[4] ..... D07B 3/02; D07B 3/06; H01B 13/02

[52] U.S. Cl. ..... 57/9; 57/6; 57/311; 57/314

[58] Field of Search ..... 57/3, 6, 9, 311, 314, 57/59

[56] References Cited

U.S. PATENT DOCUMENTS

| | | | |
|---|---|---|---|
| 1,823,886 | 9/1931 | Clark | 57/9 |
| 4,212,151 | 7/1980 | Schauffelle et al. | 57/9 |
| 4,590,752 | 5/1986 | Aubert et al. | 57/9 |

FOREIGN PATENT DOCUMENTS

| | | |
|---|---|---|
| 408972 | 9/1974 | U.S.S.R. . |
| 703613 | 12/1979 | U.S.S.R. . |
| 730906 | 5/1980 | U.S.S.R. . |
| 859513 | 8/1981 | U.S.S.R. . |
| 1152986 | 4/1985 | U.S.S.R. . |

*Primary Examiner*—John Petrakes
*Attorney, Agent, or Firm*—Lilling & Greenspan

[57] ABSTRACT

A method of manufacturing wire ropes, in which a translational motion is imparted to wires (2) fed from reels and before the twisting of these wires around the core member (11) they are given a residual deformation by way of subjecting each wire (2) to a flat bending on one support (3) and to a helical bending in the direction revolved relative to the direction of the flat bending. A wire rope twisting machine in which a device for imparting a residual deformation to the wires (2) is secured on an output portion of a hollow shaft (14) coaxially therewith includes a body (23) on which are installed for each wire (2) two supports (26, 27) arranged in succession. The first support (26) is installed for free rotation about its geometrical axis (28*a*) and the second support (27) is installed for free rotation relative to its geometrical axis (31*a*) and for a setting turn about an axis (33*a*) disposed perpendicularly to the geometrical axis (31*a*) of the second support (27).

10 Claims, 3 Drawing Sheets

METHOD OF MANUFACTURING WIRE ROPES AND WIRE ROPE TWISTING MACHINE FOR EFFECTING THE SAME

BACKGROUND OF THE INVENTION

1. Field of the Invention

The present invention relates to methods of manufacturing wire ropes and designs of wire rope twisting machines.

2. Description of the Prior Art

Widely known in the prior art is a method of manufacturing wire ropes in which wires of round section fed from reels are imparted, before their twisting around a core member, with a residual deformation along a helical line. To this end, each wire is given a translational motion and a rotary motion about its geometrical axis and then the wire is bent on supports installed in succession. The deformed wires are twisted around a core member, reduced, pulled and the resulting wire rope is wound on a drum.

Also widely known in the prior art is a wire rope twisting machine which effects the method heretofore described. This machine comprises the following units installed in succession: a drum with a core member wound thereon; a rotor with reels installed on a hollow shaft through which the core member is passed; a body carrying supports rounded by wires and secured on an output portion of the hollow shaft coaxially therewith; a reducing die in which the deformed wires are twisted around the core member and reduced; a pull mechanism and a take-up drum for winding of the wire rope.

To obtain a residual deformation along the helical line, each wire is simultaneously given an axial rotation and a translational motion with a helical bending on the supports. To provide an axial rotation of the wire, each reel is installed in a revolving support on a frame. The frame is installed on its own revolving supports in the rotor. The axis of rotation of the frame is disposed perpendicularly to the axis of rotation of the reel. All the frames are kinematically associated with a drive for rotating them relative to their own supports.

The heretofore described wire rope twisting machine effecting the widely known method is comparatively complicated in design due to installation of the reels in positively revolved frames. This leads to an increase in the overall dimensions and weight of the rotor which in its turn limits the rotational speed thereof and output of the machine as a whole. In addition, such a machine demands a substantial consumption of power.

Known in the prior art is a method of manufacturing wire ropes in which a residual deformation along the helical line is imparted to each wire in the following way: in the process of its translational motion from the reel each wire is bent in a loop which is rotated about the axis of the wire, thereby imparting thereto a required axial rotation when it leaves the loop with a plastic twisting of the wire when it enters the loop; further the wire during its translational motion and rotary motion relative to its geometrical axis is bent on supports (cf. USSR Inventor's Certificate No. 859,513, published on Aug. 30, 1981). As to the rest, the method is similar to that described hereinabove.

Also known in the prior art is a wire rope twisting machine which comprises units installed in succession; a drum with a core member wound thereon; a rotor carrying reels with wire and mounted on a hollow shaft through which the core member is passed; a device for imparting a residual deformation to the wires, secured on an output portion of the hollow shaft coaxially therewith; a reducing die in which the deformed wires are twisted around the core member and reduced; and a pull mechanism and a take-up drum for a wire rope.

A device for imparting a residual deformation to wires comprises a body with hollow shafts installed thereon along the periphery the number of which corresponds to the number of wires to be twisted, and a support for bending each wire. The hollow shafts are kinematically associated with a drive for their rotation. An input portion of each hollow shaft is provided with a fork in which on an axle offset relative to the axis of the hollow shaft is installed a roller adapted for free rotation. This roller serves for bending in a loop the translationally moving wire which further passes through a center hole of the hollow shaft.

Positive rotation of the hollow shaft with the roller and hence of the wire loop surrounding the roller effects a continuous plastic twisting of the wire before it rounds the roller and provides rotation of this wire about its geometrical axis when it leaves the roller, required for imparting the residual deformation to the wire along the helical line.

Further the wire rounds the supports, thereby obtaining the required residual deformation along the helical line (cf. USSR Inventor's Certificate No. 730,906, published on Apr. 30, 1980).

The heretofore described wire rope twisting machine effecting the known method is also comparatively complicated in design.

For imparting an axial rotation to the wire, the latter is bent in a loop on the roller. To impart the residual deformation with a required accuracy to each wire along the helical line, its bending in a loop is accomplished with as great a degree of the elastic deformation as is practically possible. This is effected on a roller of comparatively large dimensions, which serves for bending the wire in a loop. Large dimensions of rollers increase the overall dimensions of the body which mounts these rollers together with the hollow shafts which complicates the drive for rotation of the hollow shafts and the design of the device as a whole. The large overall dimensions of the device for imparting a residual deformation to wires along the helical line respectively increase the mass of revolving parts of the rope twisting machine rotor. This limits the rotor speed and the output of the wire rope twisting machine as a whole. In addition, such a design of the wire rope twisting machine demands a substantial consumption of power.

SUMMARY OF THE INVENTION

The invention is essentially aimed at providing such a method of manufacturing wire ropes and a wire rope twisting macine in which a residual deformation is imparted to wires by more simple means which will make it possible to simplify the design of the wire rope twisting machine, reduce the mass of the rotor revolving parts and thus to increase the output of the machine.

This is attained by a method of manufacturing wire ropes, in which a translational motion is imparted to wires of a round section fed from reels and a residual deformation is imparted to these wires before their twisting around a core member. According to the invention, the residual deformation is obtained by way of a flat bending of each wire at least on one support and its helical bending in a plane revolved relative to the plane of the initial simple bending.

The simple bending may conveniently be obtained by way in which the wire rounds the surface of a support.

The flat bending of the wire may be obtained at least on two supports by means of a third one.

Such an embodiment of the flat bending is advantageous when a rope is twisted of a comparatively large number of wires.

It is expedient to effect a helical bending by winding the wire along the helix.

Such an embodiment of the bending is most advantageous when a rope is twisted of wires having a comparatively small diameter and when the number of wires is small.

A helical bending may be accomplished by providing a point contact of the wire with the surface of at least one support. Such an embodiment of the helical bending is advantageous when a rope is twisted of wires having a comparatively large diameter.

For effecting the method, there is proposed a wire rope twisting machine comprising units installed in succession: a drum with a core member wound thereon; a rotor carrying reels with wire and mounted on a hollow shaft through which the core member is passed; a device for imparting a residual deformation to wires, secured on an output portion of the hollow shaft coaxially therewith; a reducing die in which the deformed wires are twisted around the core member and reduced; a pull mechanism and a take-up drum for a wire rope. According to the invention the device for imparting a residual deformation to wires comprises a body on which are installed for each wire two supports arranged in succession, the first of which is mounted for free rotation about its geometrical axis, and the second support is mounted for free rotation about its geometrical axis and for a setting turn about an axis disposed perpendicularly to the geometrical axis of the second support.

The machine of the invention is comparatively simple in design and has a smaller mass of the rotor obtained due to a smaller mass of the device for imparting a residual deformation to wires along the helical line.

The first support may suitably have a plurality of grooves and the second support may have an extended cylindrical surface sufficient to accommodate coils of the wires bent on the first support.

This makes it possible to additionally reduce the overall dimensions and the mass of the device for imparting a residual deformation to wires.

The method of manufacturing wire ropes and the wire rope twisting machine for effecting the same, being comparatively simple provide a substantial increase in the machine output along with the improvement in the quality of manufactured wire ropes achieved with a lesser consumption of power.

BRIEF DESCRIPTION OF DRAWINGS

The invention will now be described in greater detail with reference to specific embodiments thereof, taken in conjunction with the accompanying drawings, in which.

DESCRIPTION OF THE PREFERRED EMBODIMENTS

Figure 1:
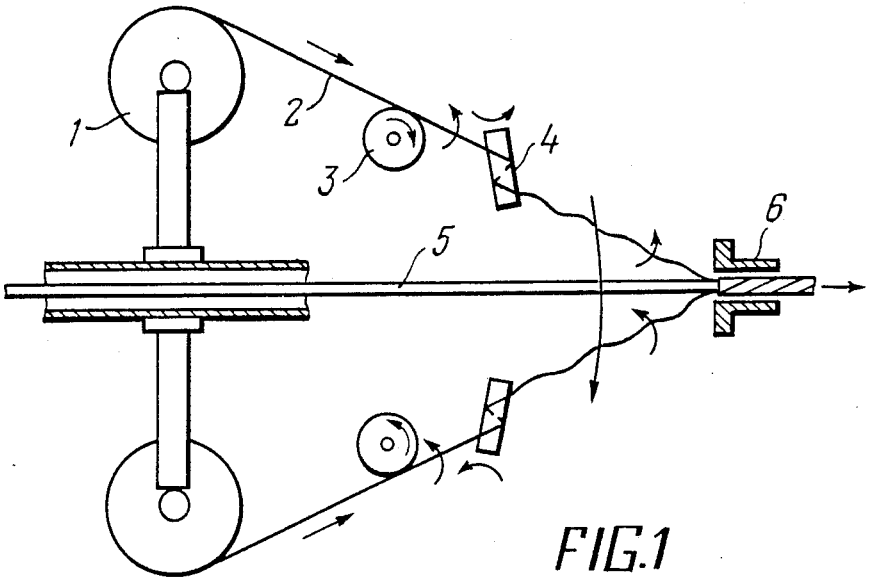
FIG. 1 diagrammatically illustrates a device for imparting a residual deformation to wires along the helical line, effecting the method of the invention.

A method of manufacturing wire ropes comprises the step of flat bending with a residual deformation accomplished on a support 3 (FIG. 1) by way of rounding it at an angle of 360° and then a helical bending in the direction revolved relative to the direction of the initial bending is imparted to each wire 2 translationally moving from a reel 1. The helical bending is accomplished on a support 4 by way of winding the wire thereon along the helix.

Figure 2:
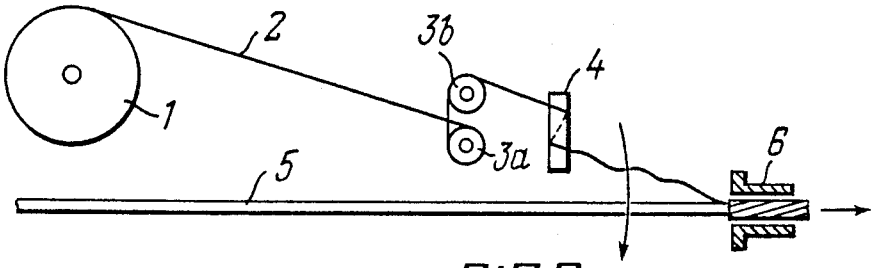
FIG. 2 shows the same with a flat bending effected on two supports.

From the supports 4 the wires 2 after receiving the required residual deformation along the helical line are wound or twisted around a core member 5 in a reducing die 6. FIG. 2 illustrates the accomplishment of a flat bending of the wire 2 on two suports 3*a* and 3*b*.

Initially the wire 2 rounds the support 3*a*, then moves to and rounds the support 3*b*, and goes further to the support 4.

Figure 3:
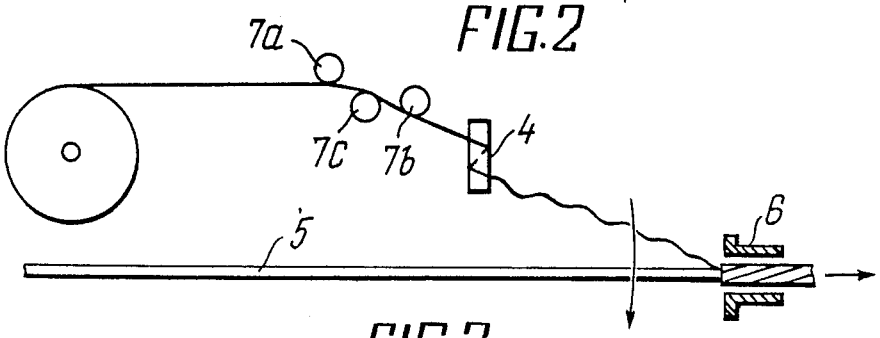
FIG. 3 shows the same with a flat bending of each wire effected on two supports by means of a third one.

The flat bending is accomplished between two supports 7*a* (FIG. 3) and 7*b* by means of a third support 7*c*.

Figure 4:
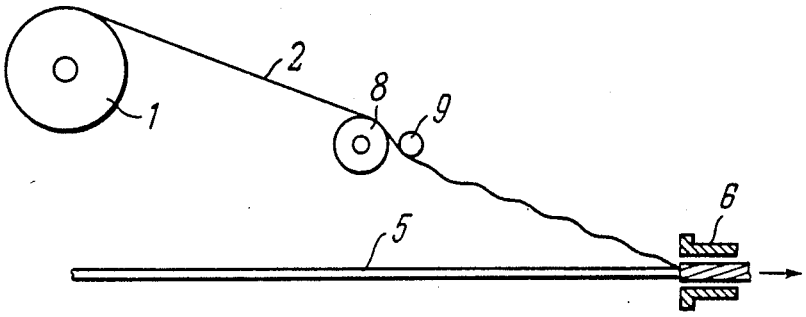
FIG. 4 shows the same with a helical bending of the wire effected by way of a point contact.

The flat and helical bendings may be obtained on two supports 8 (FIG. 4) and 9, the axes of which are substantially parallel. In case of such a helical bending the wire 2 has a point contact with the support 9.

The method of the inventions will be disclosed in greater detail in a description of operation of the wire rope twisting machine effecting the method according to the invention.

Figure 5:
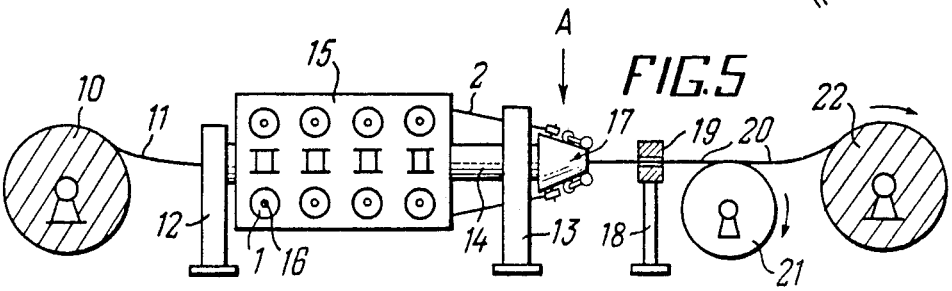
FIG. 5 is a general view of a wire rope twisting machine, according to the invention.

The wire rope twisting machine comprises a drum 10 (FIG. 5) with a core member 11 wound thereon. A hollow shaft 14 with a rotor 15 secured thereon is installed in supports 12 and 13 downstream of the drum 10. The reels 1 with the wires 2 wound thereon are installed on the rotor 15 for rotation about their axes. Mounted on an output portion of the shaft 14 is a device 17 for imparting a residual deformation to the wires 2 along the helical line. Mounted further on a support 18 is a reducing die 19 in which the wires 2 with the received residual deformation along the helical line are twisted around the core member passing through the hollow shaft 14, the device 17 and the reducing die 19. A twisted and reduced wire rope 20 passes onto a pull mechanism or capstan 21 which serves as a drive for imparting a translational motion to the core member 11, the wires 2 and the wire rope 20. A take-up drum 22 serving for winding the ready wire rop 20 is installed downstream of the pull mechanism 21. The drives serving for rotation of the shaft 14 with the rotor 15, the pull mechanism 21 and the drum 22 are not shown.

Figure 6:
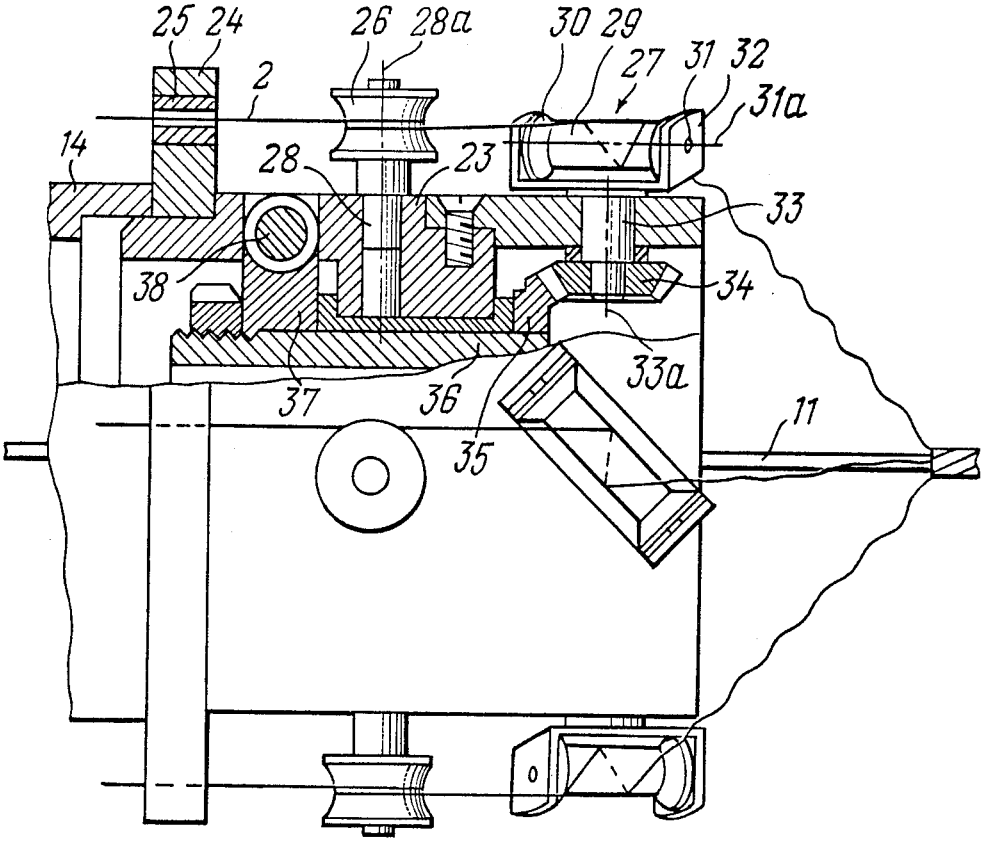
FIG. 6 is a partially cut-away view taken along the arrow A of FIG. 5 shown on an enlarged scale and illustrating a device for imparting a residual deformation to each wire along the helical line.

The device 17 for imparting a residual deformation to the wires 2 along the helical line, comprises a body 23 (FIG. 6) rigidly connected with the shaft 14. The body 23 has a flange 24 with holes 25 for passing the wire 2 and for guiding the further movement thereof. Two supports 26 and 27 are installed on the body 23 for each wire 2. All the supports 26 and 27 for the wires 2 are made identical and therefore everything in the following description that concerns the supports for one wire equally refers to the supports for the other wires. The support 26 is essentially a single-groove roller installed for free rotation about a geometrical axis 28*a* of an axle 28 secured on the body 23 and serves for imparting a flat bending to the wire 2. The support 27 is mounted on the body 23 near the support 26. The support 27 comprises a roller 29 confined by flanges 30 and installed on an axle 31 for free rotation relative to a geometrical axis 31*a* thereof. The axle 31 is secured in a frame 32 connected with a shaft 33 whose geometrical axis 33*a* is perpendicular to the axle 31 of the roller 29. Secured on the end of the shaft 33 is a bevel gear 34 interacting with a bevel gear 35 installed coaxially with the shaft 14 in the body 23. The bevel gear 35 is secured on a hollow shaft 36 the opposite end of which mounts a worm wheel 37 interacting with a worm 38 installed in the body 23. The shaft 33, the bevel gears 34 and 35, and the worm gearing 37 and 38 serve for imparting a setting turn to the support 27.

Figure 7:
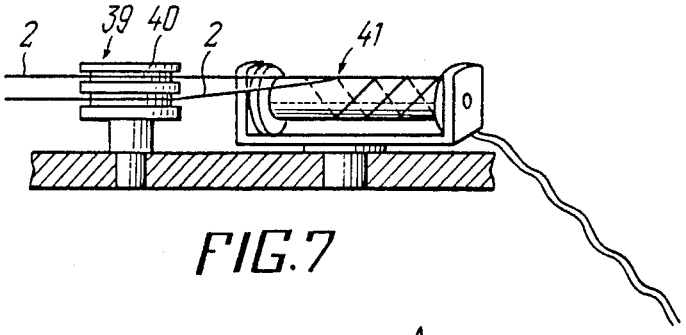
FIG. 7 illustrates two supports for disposing a group of wires thereon.

For reducing the overall dimensions and simplifying the design of the device for imparting a residual deformation to wires along the helical line, a roller 39 (FIG. 7) is made with two grooves 40 for the two wires 2 in a group. Depending on the number of wires in a group, the number of grooves may be increased.

A roller 41 has a length sufficient for accommodation of two wire coils formed from the wires 2.

Directions of the translational and rotary motions are illustrated in FIGS. 1 to 7 by arrows.

The wire rope twisting machine (FIG. 5) operates in the following way.

From the drum 10 the core member 11 is threaded through the hollow shaft 14 of the rotor 15 into the reducing die 19 in which are also threaded the wires 2 running from the reels 1 through the device 17 for imparting a residual deformation to wires. From the reducing die 19 the core member 11 together with the wires 2 is passed through the pull mechanism or capstan 21 and when up or wound on the drum 22. When the drive for rotating the rotor 15, the pull mechanism 21 and the drum 22 is switched on the manufacture of the wire rope 20 starts at a speed of the translational motion imparted thereto by the pull mechanism or capstan 21.

The wires 2 with the residual deformation along the helical line obtained in the device 17 are twisted by rotation of the rotor 15 in the supports 12 and 13 around the core member 11 in the reducing die 19 in which a twisted layer of the wires together with the core member is subjected to a consecutive reduction. The wires 2 are pulled from the reels 1 through the device 17 for imparting a residual deformation to the wires along the helical line at the expense of twisting these wires around the core member 11 in the reducing die 19 during rotation of the rotor 15 and pulling the ready wire rope 20 by the pull mechanism 21 downstream of which the ready wire rope 20 is wound on the take-up drum 22. The reels 1 are rotated about the axles 16 thereof at the expense of pulling the wires 2 and are also rotated together with the rotor 15 relative to the supports 12 and 13 thereof.

The device 17 for imparting a residual deformation to the wires 2 operates in the following way.

Upon coming out of the rotor 15 the wires 2 pass through the holes 25 (FIG. 6) in the flange 24 serving to guide the consecutive motion of the wires 2 onto the supports 26 which are essentially single-groove rollers adapted for free rotation on their axles 28. Each wire 2 rounds or wraps around the support 26 at an angle of 360° and due to its translational motion is continuously subjected for the most part to a flat bending with a residual curving required for a helical bending on the support 27. On the support 27 each wire is wound helically on the roller 29 and the direction of the bending action of this support on the wire comprises a definite angle relative to the direction of the bending action of the support 26 on the wire 2. The rollers 29 are made for free rotation on the axles 31. Due to noncoincidence in the directions of bending actions of the supports 26 and 27, initial noncoincidence of the curving of the wire flat bending with the curving of the support 27 and hence due to unstable equilibrium of the wire 2 with the flat bending on the support 27, the section of the wire 2 is turned on the support 27 in the range in which the direction of the wire residual curving obtained on the support 26 is brought in coincidence with the direction of curving of the support 27 at the point of its contact with the wire 2.

Due to the turning of this section of the wire 2 on the support 27 and a continuous translational motion of the wire, the wire 2 is continuously twisted between the supports 26 and 27, which together with the bending provides the residual deformation of the wire along the helical line.

The helical winding of the wire 2 on the support 27 provides an additional natural twisting of the wire and, consequently, an additional axial twisting of the wire between the supports 26 and 27. The flanges 30 provided on each roller 29 serve for holding the wire coil in position thereon. The value of twisting of each wire between the supports 26 and 27 is adjusted by giving a setting turn to each support 27 by means of the shaft 33. Rotation to each shaft 33 is transmitted when the worm 38 is rotated manually to actuate the worm wheel 27 and the bevel gear 35 rigidly associated through the hollow shaft 36 and interacting with the bevel gears 34 secured on the shafts 33.

If in the device for imparting a residual deformation to wires, a roller 39 (FIG. 7) is made with two or with a greater number of grooves 40 depending on the adopted number of wires in groups into which is divided the total number of wires comprising one layer on the rope, the roller 41 effecting a helical bending of the group of wires, in the given case comprising two wires, has a sufficient length for accommodation of wire coils.

If a helical bending which follows the flat bending is accomplished on a support with the point contact, the mechanism of a continuous twisting of the wire between the supports for a flat bending and a helical bending is similar to that heretofore described.

There may be a plurality of supports for accomplishing a helical bending after performing a flat bending.

A wire rope twisting machine for manufacturing a multi-layer wire rope may incorporate a required number of rotors installed in succession and provided with devices for imparting a residual deformation to wires along the helical line the designs of which are similar to those described hereinabove.

A device for imparting a residual deformation to each wire along the helical line made in the form of at least two supports installed in succession on the body and intended respectively for effecting a flat bending and a helical bending of the wire, may also be stationary if for twisting a wire rope or a like article with a single-layer twisting of wires around a core member is used a widely known machine with a revolving take-up and pulling arrangement or also a widely known double-twisting machine in which a twisting arrangement is essentially a light revolving frame surrounding in the process of rotation a frame surrounding in the process of rotation a frame suspended from axles and accommodating a pull mechanism and a take-up drum.

Both a common organic member and a metal core member may serve as a core member of the wire rope or the like article.

A core member may be essentially an electric, optical or a combination cable on which one or a plurality of wire layers are wound.

A wire or a conductor may be used as a core member.

A layer-by-layer twisting of conductors, according to the invention, may be accomplished similarly to the twisting of a wire rope described herein above.

A prototype of the wire rope twisting machine which manufactures a logging cable with two layers of high-strength steel wires has been produced and is now under testing.

The output of the prototype wire rope twisting machine is a number of times higher than that of widely known wire rope twisting machines.

Lower operating costs of the prototype machine in comparison with those of the widely known wire rope twisting machine, simple design, maintenance and repair of the prototype machine make it possible to substantially cut down the manufacturing costs, in the given case, of logging cables with two external layers of twisted steel wires.

Service tests of prototype logging cables manufactured on the prototype wire rope twisting machine demonstrate in comparison with the logging cables manufactured on the widely known wire rope twisting machines, a similar service life with a tendency for an increase in the service life of the logging cables manufactured on the prototype wire rope twisting machine.

The method of the invention may be used to best advantage for manufacture of wire ropes (cables) with a layer-by-layer twisting of steel round wires around a core member.

The invention may be used for the twisting of conductors in manufacture of cables.

We claim:

1. A method of manufacturing a wire rope consisting of a plurality of round steel wires helically twisted on a core wire, comprising the steps of deforming said plurality of round steel wires by applying two types of bending actions to said round steel wires which change the directions of bending including flat bending and helical bending, said round steel wires thereby being imparted with residual deformation along a helical line; and twisting said deformed round steel wires on the core wire.

2. A method as defined in claim 1, wherein said round steel wires are first imparted flat bending and subsequently are imparted with helical bending.

3. A method as defined in claim 1, wherein said round steel wires are plastically deformed during said at least one of said bending steps.

4. A method as defined in claim 1, wherein flat bending is achieved by at least partially wrapping each round steel wire around a surface of a first deforming support and helical bending is achieved by at least partially wrapping each round steel wire around a surface of a second deforming support displaced from said first deforming support.

5. A method as defined in claim 1, wherein flat bending is achieved by at least partially wrapping each round steel wire around surfaces of at least two first deforming supports and helical bending is achieved by at least partially wrapping each round steel wire around a surface of a second deforming support displaced from said first deforming support.

6. A method as defined in claim 5, wherein flat bending is effected with two first deforming supports.

7. A method as defined in claim 5, wherein flat bending is effected with three first deforming supports.

8. A method as defined in claim 5, wherein each round steel wire is bent by making point contact with at least one surface of at least one of said deforming supports.

9. A wire rope twisting machine for manufacturing wire ropes, comprising a successively arranged drum (10) with a core (11) wound thereon, a hollow shaft (14), a rotor (15) carrying reels (1) of wire (2) and mounted on said hollow shaft (14) through which the core (11) extends, a device (17) for imparting residual deformation to the wires (2) secured in the outlet portion of said hollow shaft (14) coaxially therewith, a reducing die (19) in which the deformed wires (2) are twisted around the core (1) and reduced, a pull mechanism (21) and a take-up drum (22) for the rope (20), wherein said device (17) for imparting residual deformation to the wires (2) comprises a body (23) having first and second successive supports (26, 27) for each wire (2) arranged therein, said first support (26) being capable of freely rotating about its geometric axis (28a), and said second support (27) being capable of freely rotating about its geometric axis (31a) and adjustingly turning about an axis (33) extending normally to the geometric axis (31a) of the second support (27).

10. A wire rope twisting machine as claimed in claim 9, wherein said first support (39) has a plurality of grooves (40), and said second support (41) has an elongated cylindrical surface sufficient to accommodate coils of wires (2) bent on the first support (39).

* * * * *